US005460494A

United States Patent [19]

Lee

[11] Patent Number: 5,460,494

[45] Date of Patent: Oct. 24, 1995

[54] ORBITING SCROLL ACTUATING MEANS OF A SCROLL-TYPE COMPRESSOR

[75] Inventor: Joon H. Lee, Seoul, Rep. of Korea

[73] Assignee: Samsung Electronics Co., Ltd., Suwon, Rep. of Korea

[21] Appl. No.: 224,787

[22] Filed: Apr. 8, 1994

[30] Foreign Application Priority Data

Jun. 8, 1993 [KR] Rep. of Korea ..... 93-10356

[51] Int. Cl.[6] ..... F04C 18/04

[52] U.S. Cl. ..... 418/14; 418/55.5; 418/57; 418/151

[58] Field of Search ..... 418/55.5, 57, 151, 418/14

[56] References Cited

U.S. PATENT DOCUMENTS 5,040,958 8/1991 Arata et al. ..... 418/55.5

5,199,862 4/1993 Kondo et al. ..... 418/55.5

FOREIGN PATENT DOCUMENTS 1273890 11/1989 Japan ..... 418/55.5

3-275902 12/1991 Japan .

5149271 6/1993 Japan ..... 418/151

*Primary Examiner*—John J. Vrablik

*Attorney, Agent, or Firm*—Burns, Doane, Swecker & Mathis

[57] ABSTRACT

A scroll compressor comprises a stationary scroll and an orbiting scroll driven by a shaft. The shaft has an eccentric pin disposed in a slot of a bushing which is mounted in the orbiting scroll. A weight is mounted for rotation with the shaft for generating a centrifugal force which is transmitted to the orbiting scroll to counterbalance a centrifugal force generated by the orbiting scroll, and thereby reduce the pressure with which the orbiting scroll bears against the stationary scroll. The weight is movable radially with respect to both the bushing and the shaft, and a spring is radially interposed between the weight and the bushing for transmitting force therebetween.

7 Claims, 4 Drawing Sheets

ORBITING SCROLL ACTUATING MEANS OF A SCROLL-TYPE COMPRESSOR

FIELD OF THE INVENTION

The present invention is related to an orbiting scroll actuating means of a scroll-type compressor, and more particularly to an orbiting scroll actuating means of a scroll-type compressor which is able to properly control centrifugal force in accordance with a change in the angular speed (rpm) of the orbiting scroll member.

BACKGROUND OF THE INVENTION

A conventional scroll-type compressor, as shown in FIG. 4, is composed of a housing 1 which has an oil container 103 divided by an oil plate 102 mounted at the lower part of the housing 1. At the upper part of the housing 1 a stationary scroll member 4 and an orbiting scroll member 3 which have an involute or spiral shape are disposed so that the orbiting scroll member 3 orbits 180 degrees against the stationary scroll member 4. The stationary scroll member 4 is fixed to the upper part of the housing 1 which is provided with a suction pipe 100, while the orbiting scroll member 3 is engaged with a shaft 210, extending downwardly from the lower surface of the orbiting scroll member 3, driven by a motor 2 which comprises a stator 201 and a rotor 200. A slide pin 212 is provided at the upper end of the shaft 210 in an eccentric manner in respect to the center of the shaft 210. The slide pin 212 is engaged with the under surface of the orbiting scroll member 3 so that the orbiting scroll member 3 orbits around the stationary scroll member 4 by the rotation of the slide or eccentric pin 212, thereby achieving a compression of the refrigerant gas. Further, a frame 5 is employed for supporting the shaft 210, and an Oldham ring 500 is provided between the lower surface of the orbiting scroll member 3 and the upper surface of the frame 5, so that the orbiting scroll member 3 is adapted to orbit without rotating around its own axis.

According to the rotation of shaft 210 by the energization of the rotor 200, the orbiting scroll member 3 moves within the frame 5 and the refrigerant gas is drawn through the suction pipe 100. The gas is compressed at the space created by the wraps 300, 400 to be changed into a high temperature and pressure gas and is discharged to the inside of the housing 1 through an opening 402 of the stationary scroll member 4, and next the pressed gas is discharged out through the discharge pipe 101 which is mounted at the lower part of the housing 1. In addition, the oil 104 in the oil container 103 is pumped by centrifugal force in accordance with the rotation of the shaft 210. The fed up oil through the oil suction passage 211 is supplied to the place to be lubricated, thereby achieving both lubrication and cooling effects.

However, at the starting stage of the compression mode, noncompressible fluid refrigerant is fed into the pockets defined by the wrap 300 of the orbiting scroll member 3 and the wrap 400 of the stationary scroll member 4, or foreign, matter is fed into the pockets. In that case, a surplus compression is applied to the wraps 300,400 which causes an excessive force that results in the problem of a deformation and dilapidation of the wraps. Furthermore, refrigerant leakage through the gap between the wraps is increased. Accordingly, the efficiency of the compression is lowered. In the case where an invertor type compressor is used for increasing the efficiency of the compression by a variable speed motor, the centrifugal force suddenly increases when the speed of the motor slowly increases. The excess frictional force and the excess compression force occur at the wraps 300,400 to create a problem which reduces their life span.

A prior art apparatus intended to solve these problems is illustrated in FIGS. 5 and 6. An orbiting scroll member 3 comprises an eccentric slide pin 212 which is provided at the upper end of the shaft 210, a bushing 320A which is engaged with the slide pin 212 and has an elliptical hole 321, and a boss 310 which is engaged with the bushing 320A. As the shaft rotates, the orbiting scroll member 3 orbits around the center of the shaft 210. The orbiting scroll member makes a compression operation by the revolution of the slide pin. The motion relation described will now be expressed in the following equations.

$$Fc-Fgr-F_R=\mu nFn \quad (1)$$

$$Fg+\mu_R F_R=-Fn \quad (2)$$

where Fc is a centrifugal force of the orbiting scroll member

Fgr is a radial compression force of refrigerant when the refrigerant is compressed $F_R$ is a contacting force of the orbiting scroll member against the stationary scroll member μnFn is a frictional force between the slide pin and the bushing Fg is a tangential force of the refrigerant in respect to the contacting force $\mu_R F_R$ is a frictional force between the wraps Fn is a perpendicular contacting force between the slide pin and the bushing The contacting force $F_R$ may be alternately expressed by using equations (1)(2) as $$F_R=(Fc-Fgr+\mu nFg)/(1-\mu n\mu_R) \quad (3)$$

where μn is a frictional factor between wraps $\mu_R$ is a frictional factor between the slide pin and the bushing Under the standard condition of the air conditioner i.e. $\mu_R=\mu m=0.1$, Fgr/Fg=0.1, the equation (3) is expressed as below $$F_R=(Fc-Fgr+0.1\ Fg)/0.99\ 0.99\ F_R/Fg=Fc/Fg \quad (4)$$

Generally, since the first term $F_R$/Fg in equation (4) is larger than zero in respect to an arbitrary value relating to Fc of the second term Fc/Fg in equation (4), the sealing force $F_R$ always exists. Hence, no gap exists between the wraps, and leakage is prevented. However, as the speed of a motor increases, the contacting force $F_R$ as well as the centrifugal force Fc increase, which brings about an increased friction between the scrolls 3, 4. That is, in the case of the invertor type compressor, which varies according to the speed of a motor, the contacting force grows greater as the centrifugal force increases, which causes excess friction and abrasion between the wraps.

In order to prevent such problem, Japanese Patent Laid-Open No. 275902/1991 discloses a scroll-type compressor wherein the bushing or contraposition member is mounted on an elongated slide pin of a guide member. The guide member is mounted eccentrically on the drive shaft and is able to swing outwardly under the influence of centrifugal force to change the angular orientation of the slide pin relative to the radial direction, whereby the contact pressure of the orbiting wrap against the stationary wrap remains constant. However, at operating frequencies below the lowest frequency predetermined by the changing angular orientation, the wraps are separated from each other, and compression can not occur, which creates a loss of efficiency.

SUMMARY OF THE INVENTION

This invention seeks to provide an orbiting scroll actuating means of a scroll-type compressor to easily and effectively solve the above mentioned problem.

An object of the present invention is to provide an orbiting scroll actuating means of a scroll-type compressor which constantly holds a sealing force between the wraps in spite of the wide span of the frequency of the motor.

Another object of the present invention is to provide an orbiting scroll actuating means of a scroll-type compressor which prevents refrigerant leakage through the gap between the wraps and increases the efficiency of the compressor.

Another object of the present invention is to provide an orbiting scroll actuating means of a scroll-type compressor which prevents over-load and excess compression during the compression mode and increases reliability.

Another object of the present invention is to provide an orbiting scroll actuating means of a scroll-type compressor which prevents friction and abrasion, and suppresses noise and vibration.

According to the present invention, an apparatus is provided in which a shaft rotates by a motor;

- an orbiting scroll member driven by an eccentric pin formed at an upper end of the shaft;
- a stationary scroll member disposed in mating relationship with the orbiting scroll member;
- a bushing making a linear reciprocating motion by a rotating motion of the eccentric pin; and
- a centrifugal force control means comprising a resilient member which counteracts a centrifugal force of the orbiting scroll member and a weight balance member for counterbalancing the centrifugal force, thereby making a linear reciprocating motion independent from the linear reciprocating motion of the bushing.

Further, the center of the shaft is provided between the weight balance and the resilient member.

Furthermore, the moving center line of the bushing and the moving center line of the weight balance member is disposed on the same line.

As a result of the above structure, as a first centrifugal force, i.e., that generated by the orbiting scroll member, increases in proportion to the increase of the rpm, the bushing moves linearly toward the resilient member, and then the orbiting scroll member bears against the stationary scroll member. Simultaneously, the distance between the center of the weight balance member and that of the shaft increases as a second centrifugal force, i.e., that generated by the weight balance member of the centrifugal force control means, and acting in a direction opposite the first centrifugal force, increases. Therefore, the first centrifugal force tends to be counterbalanced.

DETAILED DESCRIPTION OF THE PREFERRED EMBODIMENT

Figure 1:
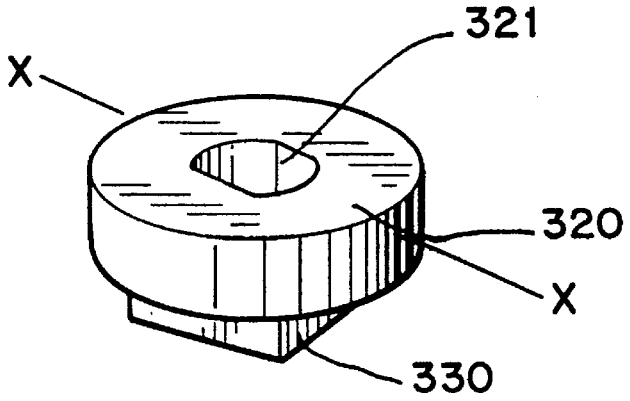
FIG. 1 is a perspective view of a brushing for use in an orbiting scroll actuating means utilizing a scroll-type compressor according to the invention.
Figure 1A:
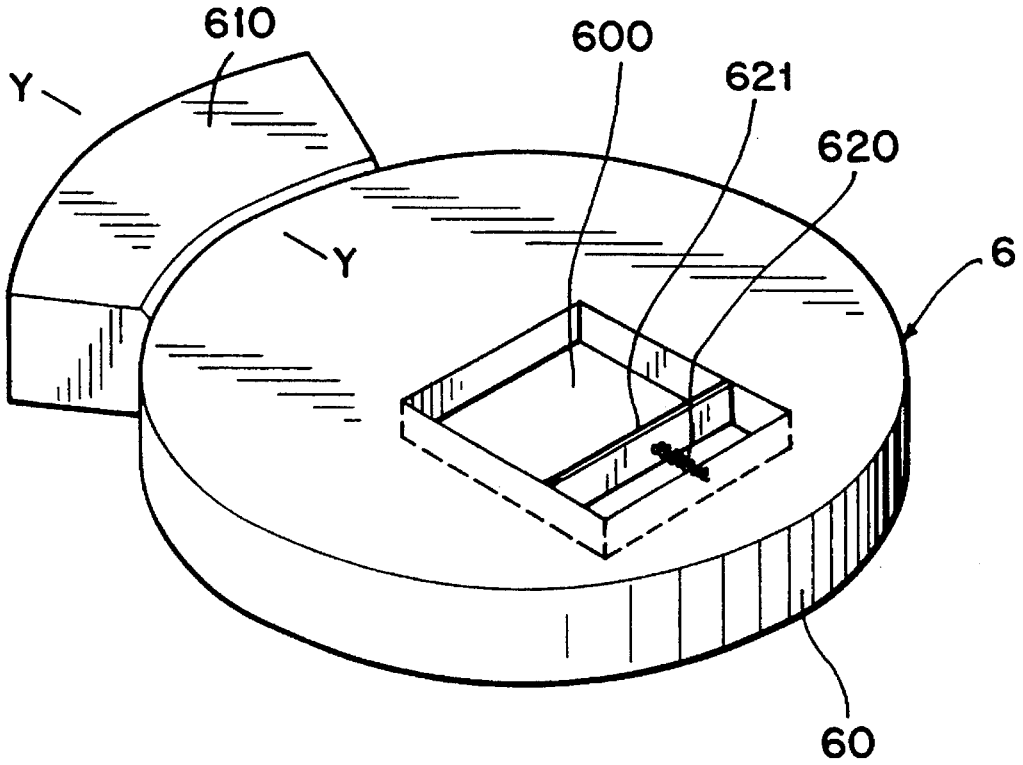
FIG. 1A is a perspective view of a centrifugal force control member of the actuating means.
Figure 2:
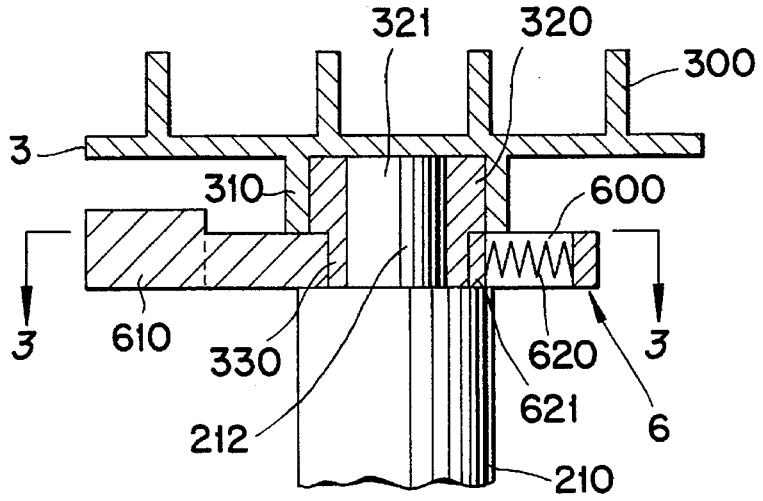
FIG. 2 is a longitudinal sectional view of an orbiting scroll actuating means assembled with an orbiting scroll member and a shaft according to the invention.
Figure 3:
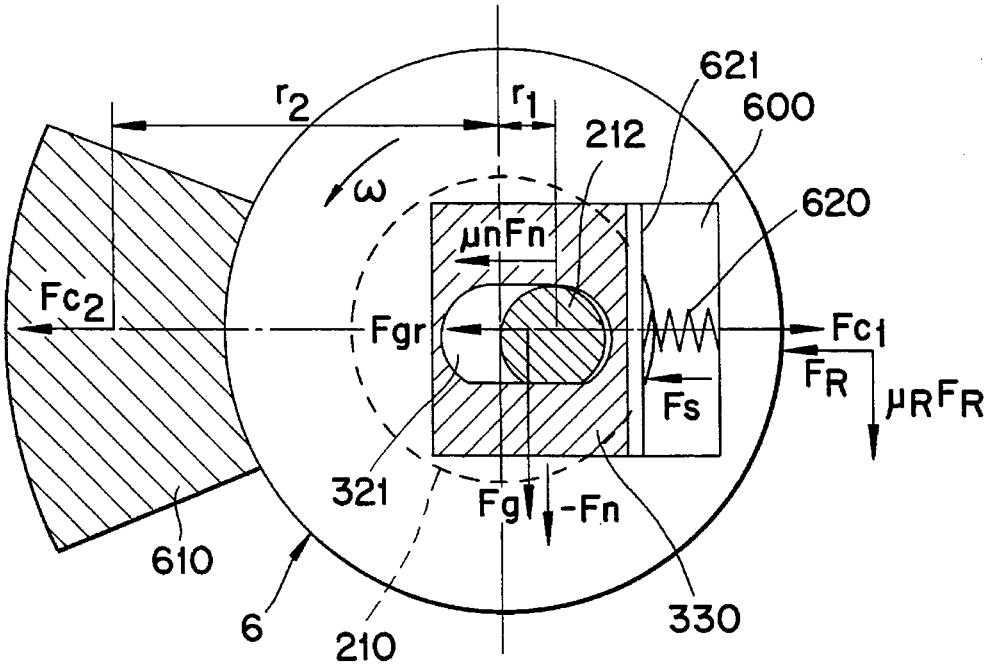
FIG. 3 is a cross-sectional view taken along the line 3—3 of FIG. 2.
Figure 4:
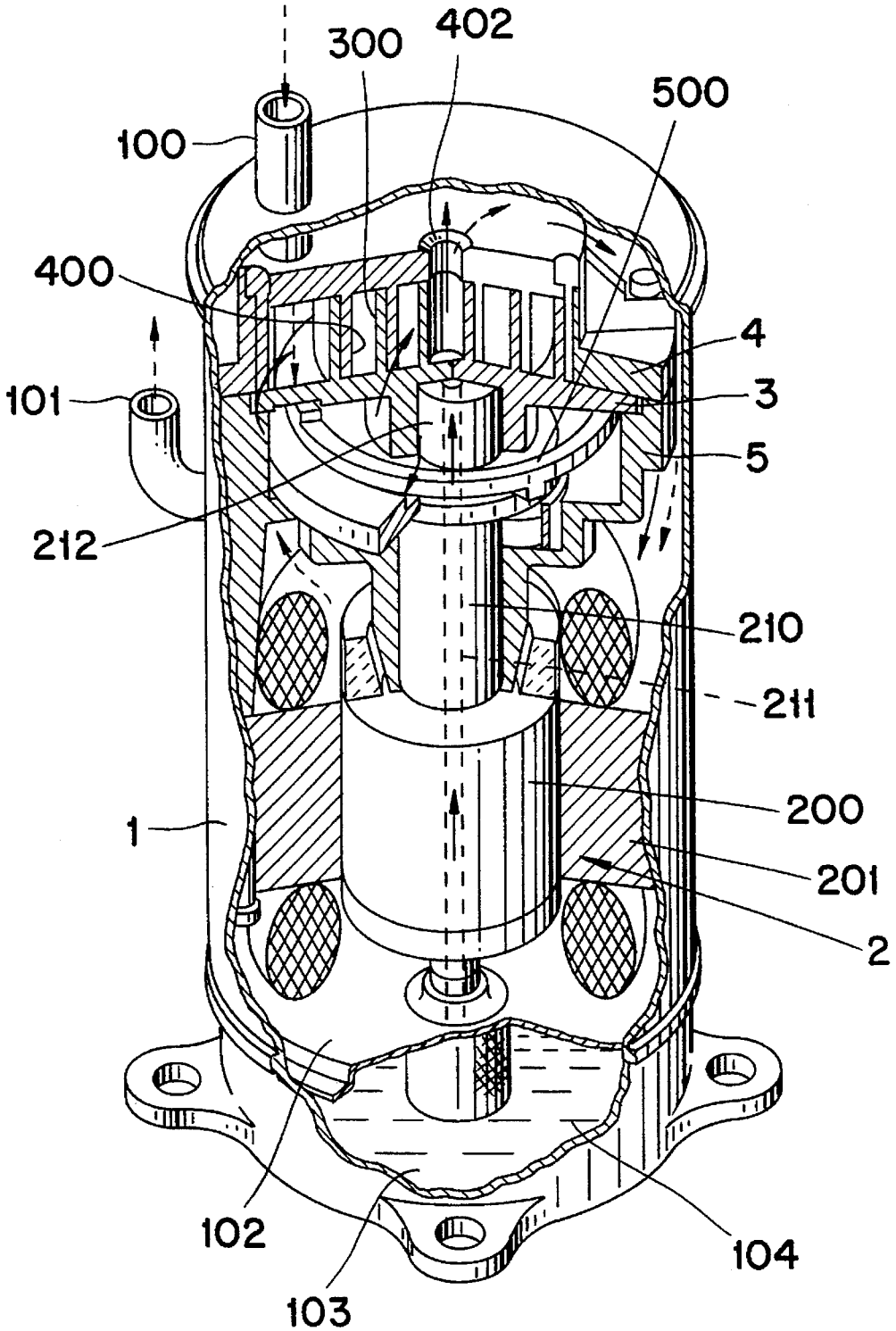
FIG. 4 (PRIOR ART)
FIG. 4 is a broken away perspective view of a scroll-type compressor according to the prior art.
Figure 5:
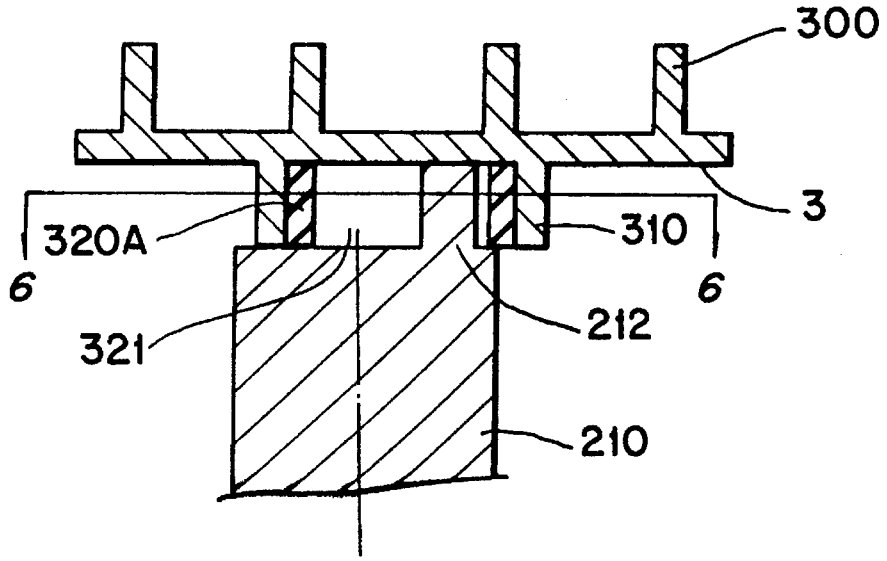
FIG. 5 (PRIOR ART)
FIG. 5 is a longitudinal sectional view of a bushing assembled with an orbiting scroll member and a shaft according to the prior art.
Figure 6:
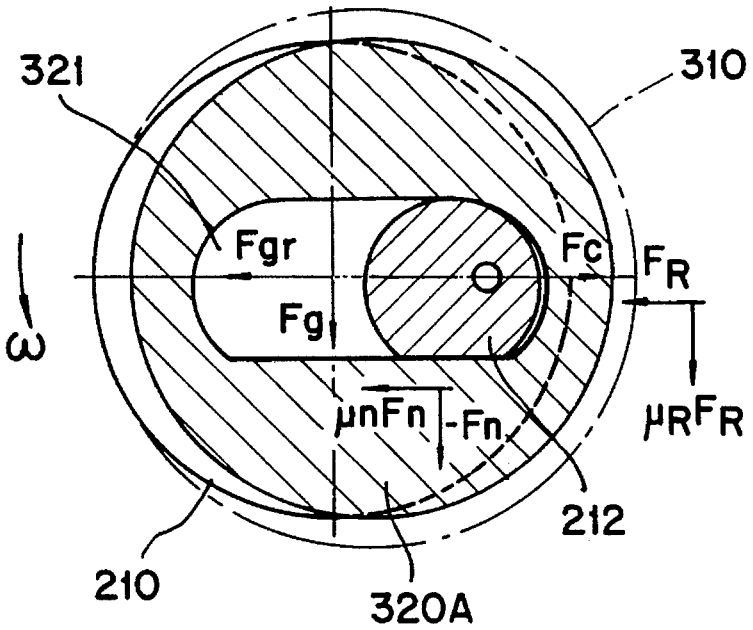
FIG. 6 (PRIOR ART)
FIG. 6 is a cross-sectional view taken along the line 6—6 of FIG. 5 except that a boss of an orbiting scroll member is shown in phantom lines.

FIGS. 1 to 3 illustrate the orbiting scroll actuating means in accordance with the preferred embodiment of the present invention. The same component parts as those in FIGS. 4 to 6 are designated by the same reference numerals as in FIGS. 1 to 3 and therefore will not be explained in detail. The orbiting scroll actuating means is provided with a slide pin 212 which is formed at the upper end of a shaft 210 driven by a motor (not shown), and a bushing 320 which has an elliptical hole 321 permitting the slide pin 212 to slide therein and which is fitted into the undersurface of an orbiting scroll member 3. The orbiting scroll actuating means further comprises a centrifugal force control means 6 which has a round plate 60 coaxially disposed on the shaft 210, a hole 600 formed eccentrically to the center of the round plate 60, and a weight balance member 610 formed at a circumference of the round plate 60. The centrifugal force control means 6 is disposed between the upper end of the shaft 210 and the lower surface of the boss 310.

At the lower surface of the bushing portion 320 an auxiliary bushing 330 is formed to slide in the hole 600 without rotation. The elliptical hole 321 extends through the auxiliary bushing portion 330. A spring 620 which pushes the auxiliary bushing portion 330 toward the middle of the round plate 6 is placed in the hole 600. To evenly apply the pushing force of the spring 620 to the auxiliary bushing portion 330 a push plate 621 is disposed between the auxiliary bushing portion 330 and spring 620.

The auxiliary bushing portion 330 of the bushing 320 is engaged with the hole 600 of the centrifugal force control means 6. The assembled components are fitted to the slide pin 212 of the shaft 210 through the elliptical hole 321 of the bushing 320. The center line X—X of the bushing 320 and the center line Y—Y of the weight balance member 610 are coincident in order to prevent the generation of a moment that would result if the lines X—X and Y—Y were offset from one another. The outer circumference of the bushing 320 is fitted into the boss 310 of the orbiting scroll member 3.

The orbiting scroll actuating means in the present invention operates as follows, with reference to FIGS. 2 and 3.

At the starting stage of the compression mode, noncompressible fluid refrigerant is already fed into the pockets defined by the wraps and the surplus compression is brought about. The bushing 320 is moved toward the center of the shaft 210 (i.e., to the left in FIG. 3) by the elastic force of the spring 620. Therefore, a gap is established between the wraps in a radial direction to prevent excess compression of the refrigerant.

In the main stage of the compression mode, the centrifugal force control means 6, the bushing 320 and the orbiting scroll member 3 are rotated in accordance with the frequency ω of the shaft 210 to increase the pressure of the refrigerant. The bushing 320 moves linearly along the hole 600 (i.e., the bushing portion 330 moves to the right in FIG. 3). Thus, the center of the bushing 320 moves away from the center of the shaft 210. The wrap 300 of the orbiting scroll member 3 comes in contact with the wrap 400 of the stationary scroll member 4 and further the wrap 300 pushes the wrap 400 with a contacting force $F_R$. The orbital displacement of the orbiting scroll 3 is defined by radius $r_1$. Since the weight balance member 610 of the centrifugal force control means 6 is disposed radially opposite the center of the orbiting scroll member 3 the member 610 creates a centrifugal force $F_{c2}$ acting against the bushing 320 (through the spring 620) in a leftward direction opposite the rightward direction of the centrifugal forces $F_{c1}$ produced by the bushing and the orbiting scroll member 3 to cancel a part of the force $F_{c1}$.

As the weight balance member 610 moves leftwards relative to the shaft 210 in FIG. 3, there occurs a compression of the spring 620, and the distance $r_2$ between the center of the weight balance member 610 and that of the shaft 210 increases (FIG. 3). The compressed spring 620 pushes against the bushing 320 with a leftward force $F_{c2}$ which partially cancels the force $F_{c1}$. Therefore, the centrifugal force $F_{c1}$ of the orbiting scroll member 3 is partially cancelled or, counterbalanced by the centrifugal force $F_{c2}$ of the member 610. Thus, the centrifugal force $F_{c2}$ of the weight balance member 610 is increased in proportion to the shaft frequency ω and the centrifugal force $F_{c1}$ of the orbiting scroll member 3 is partially counteracted. Consequently, that brings about a reduction of the resultant contacting force $F_R$ and the frictional force μnFn generated between the wraps 300,400.

The motion relation described will now be expressed in the following equations.

$$Fc_1=m_1r_1\omega^2$$

$$Fc_2=m_2r_2\omega^2$$

where $Fc_1$ is the sum of a centrifugal force of the orbiting scroll member 3 and that of the bushing 320

$r_1$ is a distance between the center of the shaft 210 and that of the slide pin 312

$Fc_2$ is a centrifugal force of the weight balance member 610

$r_2$ is a distance between the center of the weight balance member 610 and that of the shaft 210

ω is an angular velocity of the shaft 210

$$Fs=k(f_o+f)$$

where Fs is a compression force of the spring 620 k is a constant of the spring $f_o$ is an initial change value f is a change value $$Fc_1-Fgr-F_R-Fs=\mu nFn \quad (5)$$

$$Fg+\mu_RF_R-Fn \quad (6)$$

The contacting force $F_R$ may be alternately expressed by using equations (5) (6) as $$F_R=(Fc_1-Fgr-Fs-Fc_2+\mu nFg)/(1-\mu n\mu_R) \quad (7)$$

where $F_R$ is a contacting force of the orbiting scroll member against the stationary scroll member Fgr is a radial compression force of refrigerant when in compression of refrigerant μnFn is a frictional force between the slide pin and the bushing Fg is a tangential force of refrigerant in respect to the contacting force $\mu_RF_R$ is a frictional force between the wraps Fn is a vertical contacting force between the slide pin and the bushing μn is a frictional factor between wraps $\mu_R$ is a frictional factor between the slide pin and the bushing Under the standard condition of the air conditioner i.e. $\mu_R=\mu n=0.1$, Fgr/Fg=0.1, the equation (7) is expressed as below $$F_R=(Fc_1-Fgr-Fs-Fc_2+\mu nFg)/0.99\ 0.99\ F_R/Fg=(Fc_1-Fs-Fc_2)/Fg \quad (8)$$

$$=\{m_1r_1\omega^2+k(f_o+f(\omega)-m_2r_2(\omega)\omega^2\}/Fg \quad (9)$$

Since $r_2$ and f in the equations (9) are the functions of the frequency, $f(\omega)$,$r_2(\omega)$ are expressed, respectively.

To always keep the numerator of the right side term ($Fc_1$–Fs–$Fc_2$) in equation (8) a positive value, mass $m_2$ of the weight balance member 610, spring constant k, change value $f_o$, f and distance $r_2$ are chosen and then the contacting force $F_R$ always exists as a positive value. That brings about the no-gap in the radial direction between the wraps and there is no leakage of refrigerant between the wraps. Even if the frequency is increased, the contacting force $F_R$ almost always exists due to the numerator of the right side term ($Fc_1$–Fs–$Fc_2$) in equation (8). Hence, the frictional loss is no more increased in the invertor type scroll compressor. That is, in the invertor type compressor which varys the speed of the motor, the contacting force $F_R$ is almost constantly held due to the numerator of the right side term $m_1r_1\omega^2+k(f_o+f(\omega)-m_2r_2(\omega)\omega^2$ in the equation (9). That prevents the frictional abrasion and creates the increase of the compression efficiency.

With the above described operation of the present invention, in the compression mode, noncompressible fluid refrigerant or the foreign matter is fed into the pockets defined by the wraps. A surplus compression occurs in the pockets. The orbiting scroll member moves to the left in FIG. 3. That is, the gap between the scrolls 3 and 4 occurs in order to prevent excess compression. Hence, frictional abrasion and the damage generated between the wraps in respect to the excess compression are prevented.

The sealing force $F_R$ between the wraps is held constant in spite of the wide span of the revolution speed of the shaft 210. That prevents a refrigerant leakage through the gap between wraps and increases the efficiency of the compression. Further, that prevents the excess compression during the compression mode and increases the reliability of the compressor.

What is claimed is:

1. A scroll compressor comprising:

a stationary scroll;

an orbiting scroll arranged in mating relationship with the stationary scroll; and an actuating mechanism for orbiting the orbiting scroll, comprising:

a motor-driven shaft rotatable about an axis, an eccentric pin projecting eccentrically from an end of the shaft, a bushing having a slot receiving the pin, such that rotation of the shaft produces rotation of the bushing, the bushing connected to the orbiting scroll such that rotation of the bushing produces orbiting of the orbiting scroll, the bushing being movable linearly relative to the pin in the direction of the slot, the orbiting scroll being free of elastic bias against the stationary scroll, a centrifugal force controller comprising a weight mounted for rotation with the shaft for generating a centrifugal force, the weight being movable linearly relative to both the shaft and bushing and arranged such that the centrifugal force generated thereby acts against the bushing in a direction generally opposite a centrifugal force generated by the orbiting scroll to reduce the resultant force of the orbiting scroll against the stationary scroll, and an elastic member acting radially between the weight and the bushing for transmitting the centrifugal force of the weight against the bushing.

2. A scroll compressor according to claim 1, wherein the bushing includes a first end portion connected to the orbiting scroll, and a second end portion extending through the weight.

3. A scroll compressor according to claim 1, wherein the axis of the shaft is located between the elastic member and a center of gravity of the weight.

4. A scroll compressor according to claim 1, wherein the elastic member comprises a coil compression spring.

5. A scroll compressor according to claim 1, wherein the slot in the bushing extends along a diameter with reference to the axis of the shaft, a center of gravity of the weight lying on that diameter.

6. A scroll compressor according to claim 5, wherein the bushing includes a first end portion connected to the orbiting scroll, and a second end portion extending through the weight.

7. A scroll compressor according to claim 6, wherein the axis of the shaft is located between the elastic member and a center of gravity of the weight.

* * * * *